US006282852B1

(12) United States Patent
Walcker

(10) Patent No.: US 6,282,852 B1
(45) Date of Patent: Sep. 4, 2001

(54) APPARATUS FOR INSTALLING A DOOR FRAME

(76) Inventor: Vernon R. Walcker, P.O. Box 275, College Place, WA (US) 99324

( * ) Notice: Subject to any disclaimer, the term of this patent is extended or adjusted under 35 U.S.C. 154(b) by 0 days.

(21) Appl. No.: 09/502,581

(22) Filed: Feb. 11, 2000

(51) Int. Cl.[7] ..... E06B 1/04

(52) U.S. Cl. ..... 52/212; 52/213; 408/97; 144/144.51; 33/194; 33/197

(58) Field of Search ..... 52/212, DIG. 1, 52/749.1

(56) References Cited

U.S. PATENT DOCUMENTS

| | | | | |
|---|---|---|---|---|
| 3,788,378 | * | 1/1974 | Sobel | 160/135 |
| 4,154,034 | * | 5/1979 | Bursk et al. | 52/213 |
| 4,400,886 | * | 8/1983 | Bindschatel | 33/197 |
| 5,373,334 | * | 12/1994 | Coker | 33/194 |
| 5,560,112 | * | 10/1996 | Stein et al. | 33/194 |
| 5,762,115 | * | 6/1998 | Shouse | 144/144.51 |
| 5,947,656 | * | 9/1999 | Simson et al. | 408/97 |
| 5,974,745 | | 11/1999 | Barr | 52/212 |

* cited by examiner

*Primary Examiner*—Carl D. Friedman
*Assistant Examiner*—Steve Varner
(74) *Attorney, Agent, or Firm*—Liebler, Ivey & Connor; Floyd E. Ivey

(57) ABSTRACT

An apparatus for installing door frames which comprises at least two template members and at least three apertures on each template member. To provide horizontal adjustment means between said at least two template members, at least one elongated member may be joined approximately normal to each of said at least two templates. Said at least one elongated member may comprise at least one tongue member and at least one groove member, said at least one tongue member may be slidably positioned within said at least one groove member. To provide means for plumbing said template members, at least one screw may be positioned within said at least one template member. To install a door frame, the apparatus is positioned within a doorway, said doorway composed of two trimmer studs joined by a header stud, such that the at least one template of the apparatus is juxtaposed one of the two trimmer studs, and said at least one aperture outlines the perimeter of at least one slot to be cut in the trimmer stud. Using said at least one aperture as a guide, at least one slot is cut in the trimmer stud using, e.g., a router or saw. At least one shim is inserted into said trimmer stud. The apparatus may be removed (preferably before shim installation) and the door frame member is installed, said door frame member juxtaposed said at least one shim. Before cutting said at least one slot in the trimmer stud, the installer preferably ensures that the at least one template member of the apparatus is plumb by turning the at least one screw which contacts the trimmer stud and adjusts the at least one template member until the at least one template member is plumb. The door frame may then be plumb and square with a door.

13 Claims, 3 Drawing Sheets

APPARATUS FOR INSTALLING A DOOR FRAME

FIELD OF THE INVENTION

The present invention relates generally to an apparatus and a method for installing door frames and in particular to an apparatus and a method of ensuring that a door frame assembly is plumb and square with a door.

BACKGROUND OF THE INVENTION

In the construction industry, doors are typically provided along with a frame assembly for installation in a doorway. The complete door frame, which typically consists of two side jambs (a hinge jamb and a strike jamb) and a head jamb, are nailed to wall studs to form a frame around three sides of the door. The head jamb spans the distance between the side jambs at their tops. Casing members are placed around the perimeter of the doorway.

Numerous problems must often be overcome before the jambs and the door may be installed. The doorway studs may be twisted or warped. The jambs may also be warped or nonuniform. The jambs may have a camber from production at the factory.

If these problems are not corrected then the door frame may not be plumb and the reveal (the space between the door and the jambs) may not be uniform. The door may then not open and close properly. The strike jamb may rub against the door when closed. There may further be tension between the door and the hinge jamb. The door may rub against the floor or head jamb, The door may tend to swing in an open or closed direction by itself.

Various devices and methods have been attempted to overcome these problems and ensure that the jambs are plumb and the reveal is uniform. However, none of these devices or methods achieve the result as contemplated by the present invention. Typically, an installer will insert tapered shims between the jambs and the studs in an attempt to adjust the reveal and square the jambs. This is time-consuming and may not be effective for severe warping.

U.S. Pat. No. 5,974,745 to Barr discloses a self-aligning prefabricated door frame assembly that employs casings that automatically adjust for irregularities in a roughed-in frame. Shinning hardware may also be included to attain the proper fit between the jambs and the stud lumber.

The patent referred to herein is provided herewith in an Information Disclosure Statement in accordance with 37 CFR 1.97.

SUMMARY OF THE INVENTION

The present invention discloses an apparatus for installing door frames which may comprise at least one template member having a first end, a second end, and at least one aperture formed therein. The apparatus preferably comprises at least two template, members. The apparatus preferably comprises at least three apertures on each template member.

The apparatus may further include means, joined to said at least two template members, for horizontally adjusting said at least two template members relative to each other. Said horizontally adjusting means may include, but is not limited to, at least one elongated member joined approximately normal to each of said at least two templates. Said at least one elongated member preferably comprises at least one first member and at least one second member. In one embodiment said at least one first member may be slidably positioned within said at least one second member.

Securing means such as, but not limited to, at least one set screw 99, bolt, pin or clamp may be used to secure the at least one first member and the at least one second member in their desired positions. For example, said securing means may be positioned through one of said at least one first or second members to secure the at least one first and second members in their desired positions by friction.

In an alternative embodiment, said at least one first member and said at least one second member comprises at least one hole located therein. Said securing means may be positioned through said at least one hole thereby securing said at least one first member and said at least one second member in place. Said securing means may include a hand retractable spring plunger which includes a pin and locking mechanism employing biasing means such as a spring to ensure the pin stays in place when pressed. The preferred positions of said at least one first and second members are the positions that result in the at least two template members being substantially parallel.

The apparatus may further comprise means, joined to each of said at least two template members, for plumbing said template members. Said plumbing means may comprise, but is not limited to, at least one screw positioned within said at least one template member. Besides a screw, other plumbing means may include, but are not limited to, at least one bolt, pe& pin or other members.

To install a door frame the apparatus is positioned within a doorway, said doorway composed of two trimmer studs joined by a header stud, such that each of the at least one template members of the apparatus is juxtaposed one of the two trimmer studs, and said at least one aperture outlines the perimeter of at least one slot to be cut in the trimmer stud. Using said at least one aperture as a guide, at least one slot is cut in the trimmer stud using, e.g., a router or saw. At least one shim, which is preferably a non-tapered shim, may then be inserted into said trimmer stud. The apparatus is removed and the door frame member is installed, said door frame member juxtaposed said at least one shim.

Before cutting said at least one slot in the trimmer stud, the installer preferably ensures that the at least one template member of the apparatus is substantially plumb. The installer may turn the at least one screw which contacts the trimmer stud and adjusts the at least one template member until the at least one template member is plumb. The hinge jamb and strike jamb may then be plumb and substantially square with the door. If the apparatus comprises at least two template members, the installer preferably ensures that said at least two template members are substantially parallel.

The process steps are not limited to the order set forth herein. For example, in the preferred embodiment, the apparatus may be removed before said at least one shim is inserted into said trimmer stud.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION OF THE PREFERRED EMBODIMENT(S)

FIGS. 1–4 illustrate the preferred embodiment wherein the apparatus 10 for installing door frames may comprise at least one template member 17 having a first end, a second end, and at least one aperture 20 formed therein. The apparatus 10 preferably comprises at least two template members 17A, 17B joined together. The apparatus 10 preferably comprises at least three apertures on each template member 17.

Figure 1:
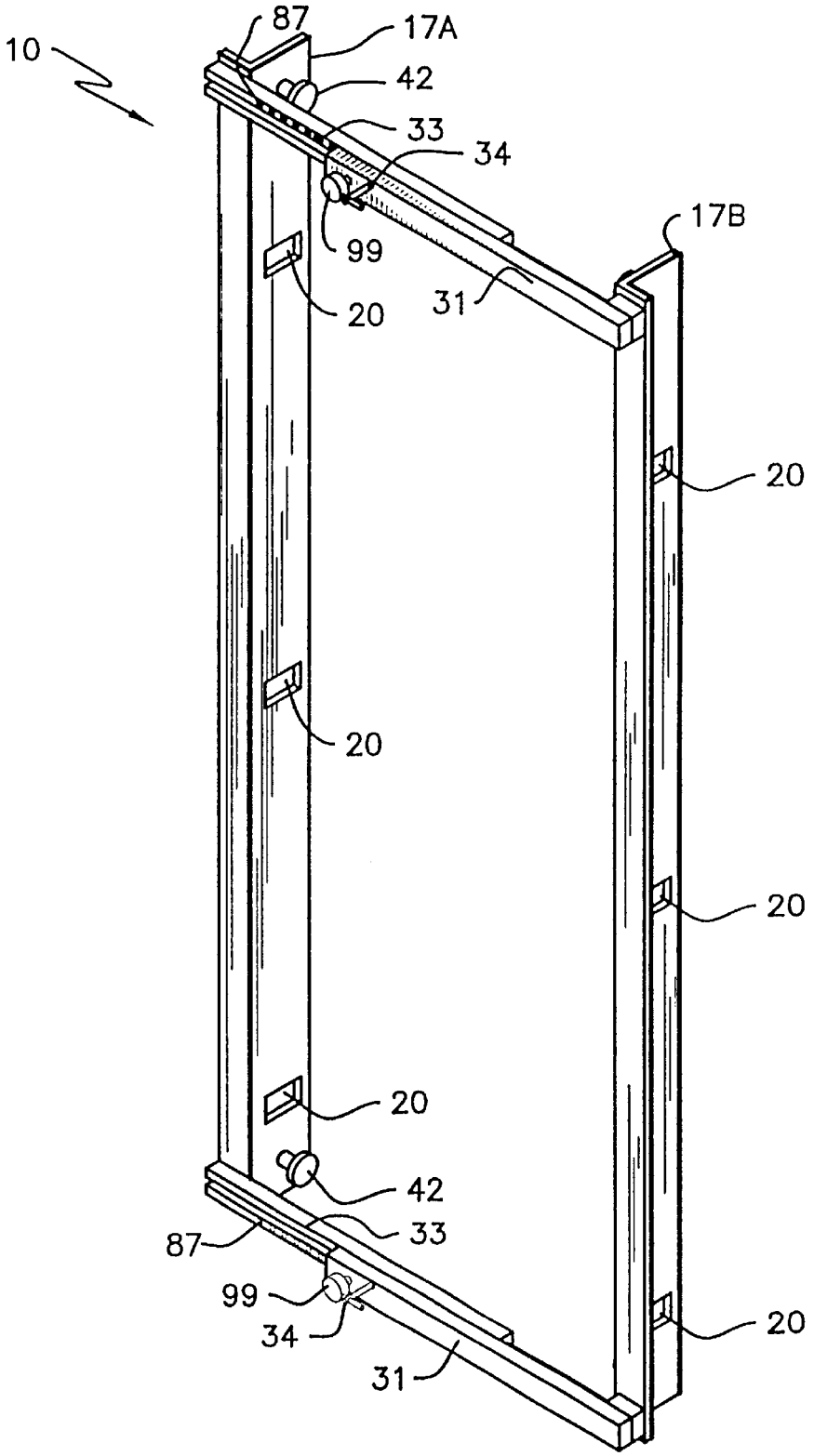
FIG. 1 is a perspective view of the apparatus showing the template members, apertures, screws, and first and second members.
Figure 3:
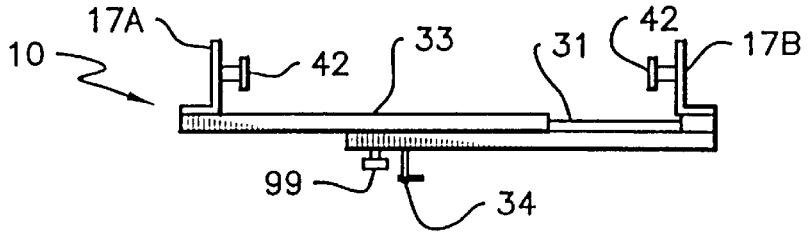
FIG. 3 is a top view of the apparatus showing the template members, screws, and tongue and groove members.

The apparatus 10 may further include means, joined to said at least two template members 17A, 17B, for horizontally adjusting said at least two template members 17A, 17B relative to each other. Said horizontally adjusting means may include, but is not limited to, at least one elongated member joined approximately normal to each of said at least two template members 17A, 17B. Said at least one elongated member preferably comprises at least one first member 31 and at least one second member 33. In one embodiment said at least one first member 31 may be slidably positioned within said at least one second member 33. For example, as best shown in FIG. 1 said at least one elongated member may comprise at least one tongue member 31 and at least one groove member 33, said at least one tongue member 31 may be slidably positioned within said at least one groove member 33. While the tongue and groove arrangement is preferred, other arrangements may work as well including, but not limited to, non-tongue and groove members slidably positioned with respect to each other, or at least one threaded or toothed elongated member movably joined to another elongated member by a bolt or gear mechanism. Said horizontally adjusting means may be joined anywhere along the at least two template members, but preferably near or at the ends of said template members as shown in the figures.

Said at least one elongated member may further include numbers to provide the user with a means for determining the proper template span for various door frames. The apparatus may further include level means, including but not limited to at least one bubble in fluid indicator, to measure angular positions and deviations from the horizontal and vertical.

Securing means such as, but not limited to, at least one set screw 99, bolt, pin or clamp may be used to secure the at least one first member and the at least one second member in their desired positions. For example, said securing means may be positioned through one of said at least one first or second members to secure the at least one first and second members in their desired positions by friction.

Figure 2:
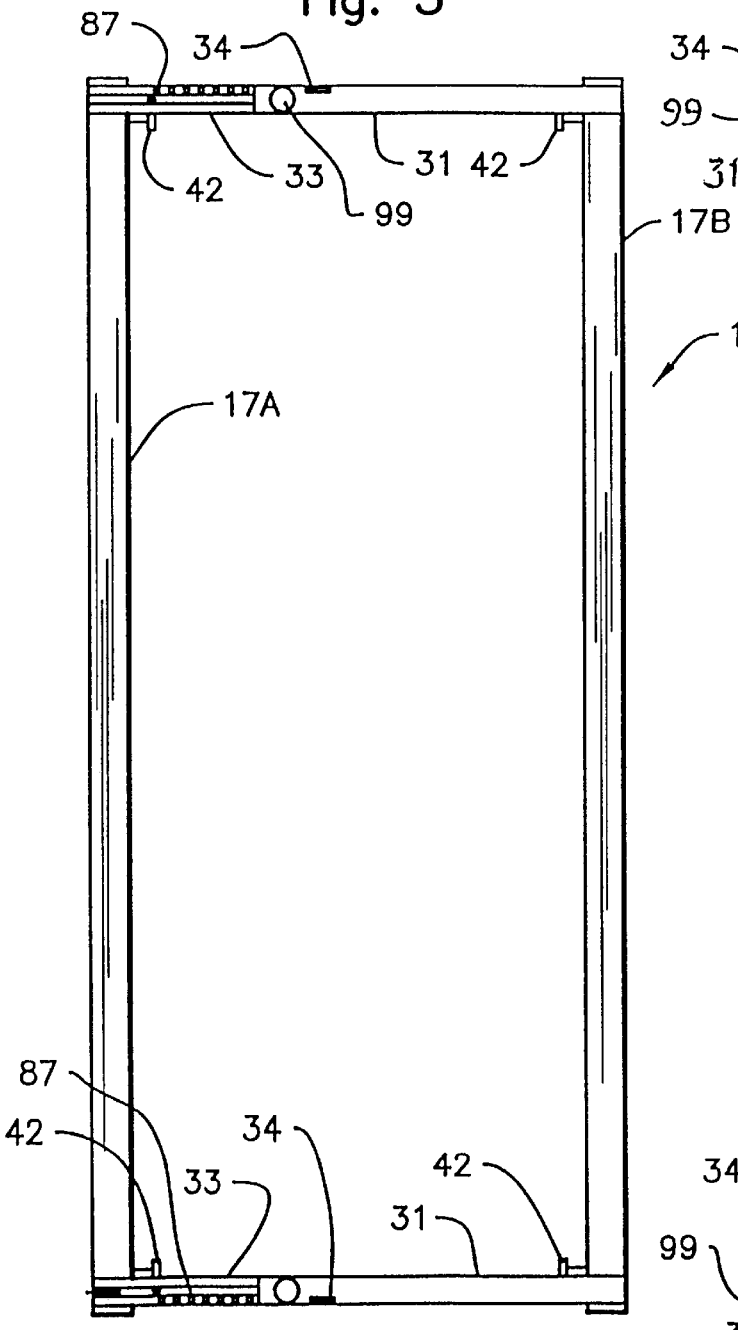
FIG. 2 is a front view of the apparatus showing the template members, screws, and first and and members.
Figure 4:
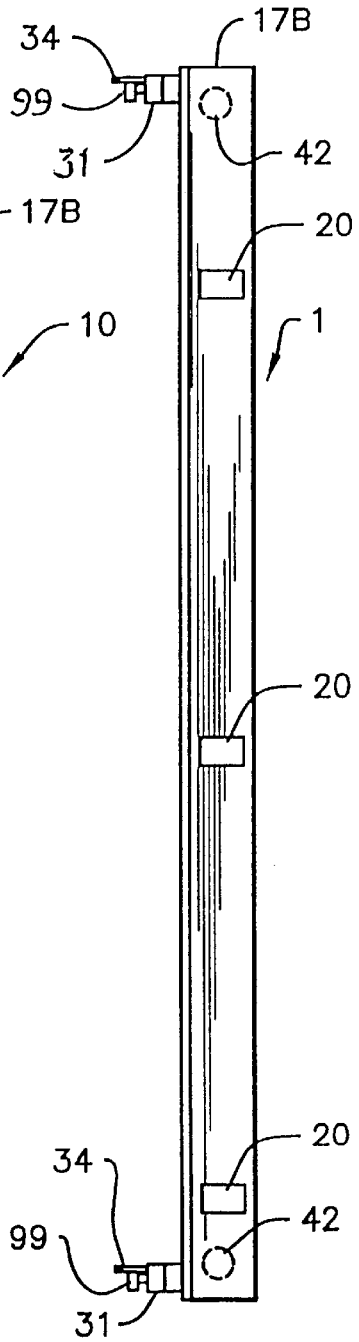
FIG. 4 is a side view of the apparatus showing the template member and apertures.

In an alternative embodiment as best shown in FIGS. 1–2, said at least one first member and said at least one second member comprises at least one hole 87 located therein. Said securing means may be positioned through said at least one hole on each of the at least one first member and said at least one second member, thereby securing said at least one first member and said at least one second member in place. Said securing means may include a hand retractable spring plunger 34 which includes a pin and locking mechanism employing biasing means such as a spring to ensure the pin stays in place when pressed. The preferred positions of said at least one first and second members are the positions that result in the at least two template members being substantially parallel.

The apparatus 10 may further comprise means 42, joined to each of said at least two template members 17A, 17B, for plumbing said template members 17A, 17B. Said plumbing means 42 may comprise, but is not limited to, at least one screw 42 positioned within said at least one template member 17. Besides a screw, other plumbing means may include, but are not limited to, at least one bolt, peg, pin or other members.

Said at least one template 17 is preferably composed of a rigid material including but not limited to metal, e.g., aluminum or steel, wood, or plastic compositions.

The apparatus may further include support means such as a flange extension (not shown) to facilitate storage of the apparatus in an upright position. This may avoid the need to lean the apparatus against a wall when not in use.

Figure 5:
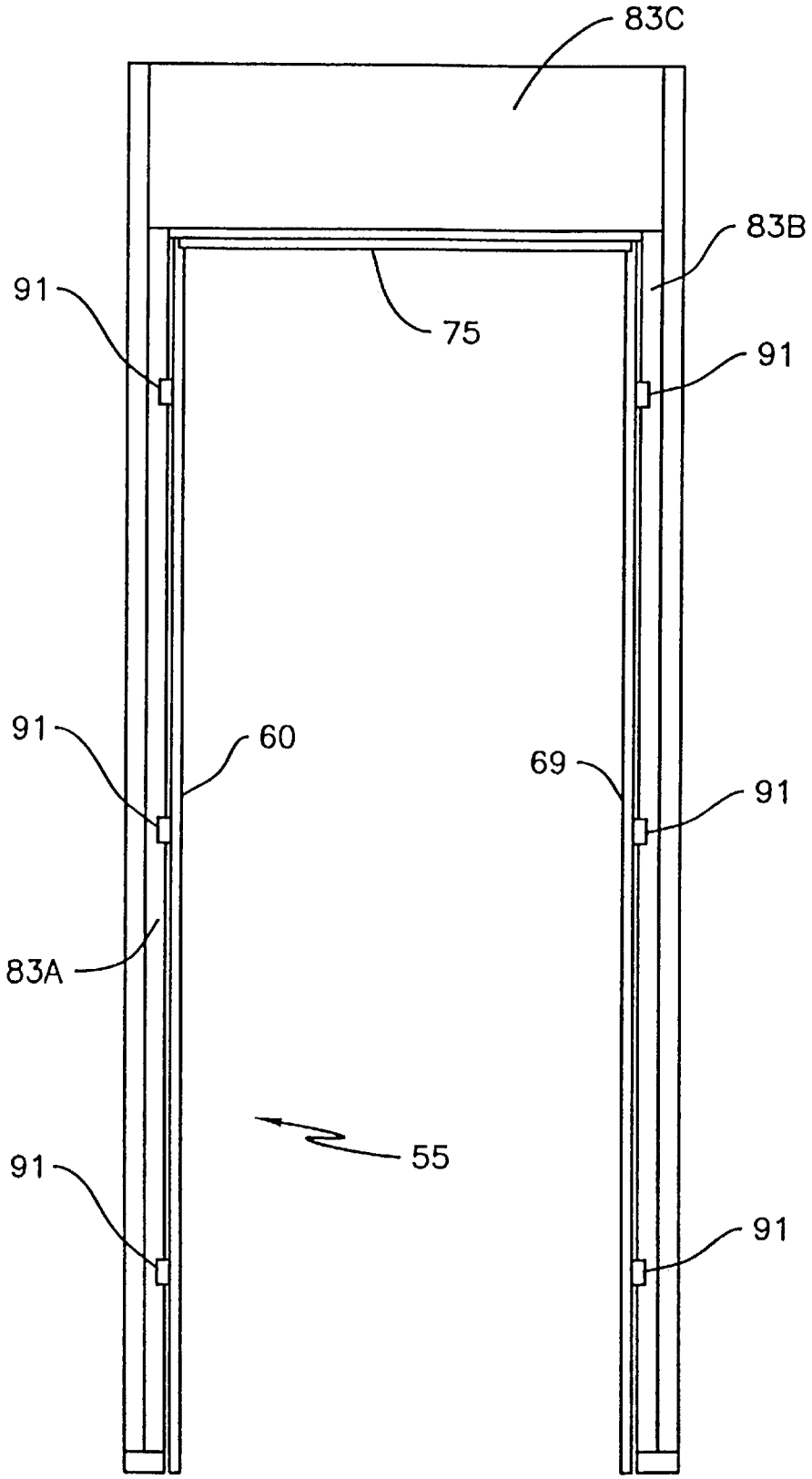
FIG. 5 is a front view of a doorway showing the trimmer studs, header stud, shims, and a door frame including the hinge, strike, and head jambs.

To install a door frame 55, the apparatus 10 is positioned within a doorway, said doorway composed of two trimmer studs 83A,B joined by a header stud 83C, such that each of the at least one template members 17 of the apparatus 10 is juxtaposed one of the two trimmer studs 83, and said at least one aperture 20 outlines the perimeter of at least one slot to be cut in the trimmer stud. Using said at least one aperture 20 as a guide, at least one slot is cut in the trimmer stud 83 using, e.g., a router or saw. At least one shim 91, which is preferably a non-tapered shim, may then be inserted into said trimmer stud 83. The apparatus 10 is removed and the door frame member is installed, said door frame member juxtaposed said at least one shim 83 as shown in FIG. 5.

Before cutting said at least one slot in the trimmer stud 83, the installer preferably ensures that the at least one template member 17 of the apparatus 10 is substantially plumb. The installer may turn the at least one screw 42 which contacts the trimmer stud 83 and adjusts the at least one template member 17 until the at least one template member 17 is plumb. The hinge jamb 60 and strike jamb 69 may then be plumb and substantially square with the door. If the apparatus comprises at least two template members, the installer preferably ensures that said at least two template members are substantially parallel.

The process steps are not limited to the order set forth herein. For example, in the preferred embodiment, the apparatus may be removed before said at least one shim is inserted into said trimmer stud.

While a preferred embodiment of the present invention has been shown and described, it will be apparent to those skilled in the art that many changes and modifications may be made without departing from the invention in its broader aspects. For example, the apparatus may include a template member for ensuring correct alignment of the head jamb 75 e.g., for long jambs as found in French doors, as well as the hinge and strike jambs. Moreover, the jambs may be of any sizes. The appended claims are therefore intended to cover all such changes and modifications as fall within the true spirit and scope of the invention.

I claim:

1. An apparatus for installing door frames which comprises:

a. at least two template member having a first end, a second end, and at least one aperture formed therein; the at least two template members joined together;

b. means, joined to said at least two template members, for horizontally adjusting said at least two template members relative to each other;

c. means, joined to each of said at least two template members, for plumbing said template members;

d. the means for horizontally adjusting said at least two template members relative to each other and the means, joined to each of said at least two template member, for plumbing said template members provide means for positioning the at least one aperture within a doorway, said doorway composed of two trimmer studs joined by a header stud, such that each of the at least two template members and the at least one aperture is juxtaposed to at least one of the two trimmer studs, such that a router or saw may be received through the at least one aperture to cut at least one slot, to receive at least one shim in the trimmer stud.

2. The apparatus of claim 1 wherein:

a. said at least one aperture comprises three apertures.

3. The apparatus of claim 1 wherein:

a. said horizontally adjusting means comprises at least one elongated member joined approximately normal to each of said at least two template members, said at least one elongated member comprises at least one first member and at least one second member, said at least one first member slidably positioned within said at least one second member;

b. means, joined to said at least one first member and said at least one second member for securing said members in place.

4. The apparatus of claim 3 further comprising:

a. at least one hole located on said at least one first member;

b. at least one hole located on said second member.

5. The apparatus of claim 4 wherein:

a said securing means is positioned through said at least one hole on each of the at least one first member and said at least one second member.

6. The apparatus of claim 5 wherein:

a. said plumbing means comprises at least one screw positioned within each of said at least two template members for contact with the juxtaposed trimmer stud.

7. The apparatus of claim 1 wherein:

a. said at least one template is composed of a rigid material.

8. A method of installing a door frame, comprising the steps of:

a. positioning the apparatus of claim 1 within a doorway, said doorway composed of two trimmer studs joined by a header stud, such that each of the at least two template members of the apparatus is juxtaposed one of the two trimmer studs, said at least one aperture outlining the perimeter of at least one slot to be cut in the trimmer stud;

b. cutting at least one slot in the trimmer stud;

c. inserting at least one shim into said trimmer stud;

d. removing said apparatus of claim 1; and e. installing a door frame member, said door frame member juxtaposed said at least one shim.

9. The method of claim 8 further comprising the step of ensuring that the at least two template members of the apparatus of claim 1 are substantially plumb before cutting said at least one slot in the trimmer stud.

10. The method of claim 8 further comprising the step of ensuring that the at least two template members are substantially parallel before cutting said at least one slot in the trimmer stud.

11. A method of installing a door frame, comprising the steps of:

a. positioning the apparatus of claim 1 within a doorway, said doorway composed of two trimmer studs joined by a header stud, such that each of the at least two template members of the apparatus is juxtaposed one of the two trimmer studs, said at least one aperture outlining the perimeter of at least one slot to be cut in the trimmer stud;

b. cutting at least one slot in the trimmer stud;

c. removing said apparatus of claim 1;

d. inserting at least one shim into said trimmer stud; and e. installing a door frame member, said door frame member juxtaposed said at least one shim.

12. The method of claim 11 further comprising the step of ensuring that the at least two template members of the apparatus of claim 1 are substantially plumb before cutting said at least one slot in the trimmer stud.

13. The method of claim 11 further comprising the step of ensuring that the at least two template members are substantially parallel before cutting said at least one slot in the trimmer stud.

* * * * *